US006285122B1

(12) United States Patent
Hosotani

(10) Patent No.: US 6,285,122 B1
(45) **Date of Patent: *Sep. 4, 2001**

(54) COLOR CATHODE RAY TUBE WITH COVER FILM ON PANEL UNIT

(75) Inventor: Nobuhiko Hosotani, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/603,962

(22) Filed: Jun. 26, 2000

Related U.S. Application Data

(63) Continuation of application No. 09/443,304, filed on Nov. 19, 1999, now Pat. No. 6,114,803, which is a continuation of application No. 09/018,311, filed on Feb. 3, 1998, now Pat. No. 6,140,756.

(30) Foreign Application Priority Data

Feb. 6, 1997 (JP) ..... 9-23786

(51) Int. Cl.[7] ..... H01J 29/10

(52) U.S. Cl. ..... 313/461; 313/463; 313/466; 313/469; 313/471; 313/402

(58) Field of Search ..... 313/461, 463, 313/477 R, 466, 469, 470, 471, 473, 476, 402

(56) References Cited

U.S. PATENT DOCUMENTS 5,660,876 8/1997 Kojima et al. ..... 427/64
5,869,929 * 2/1999 Eida et al. ..... 313/501
6,114,803 * 9/2000 Hosotani ..... 313/461
6,140,756 * 10/2000 Hosotani ..... 313/461

OTHER PUBLICATIONS

"Hitachi Color Display Tubes", Hitachi, Ltd., Sep. 1995.

"M48KFH60X", Registration/Registration Format, World Type Designation System, pp. 1–3.

"M41KSX60X", Registration/Registration Format, World Type Designation System, pp. 1–3.

* cited by examiner

*Primary Examiner*—Nimeshkumar D. Patel
*Assistant Examiner*—Kevin Quarterman
(74) *Attorney, Agent, or Firm*—Antonelli, Terry, Stout & Kraus, LLP

(57) ABSTRACT

A color cathode ray tube has a vacuum enclosure including a panel unit having a fluorescent film formed on an inner face, the fluorescent film consisting of densely arrayed three color dot trios of a fluorescent material. A shadow mask is mounted in the vicinity of the fluorescent film. The color cathode ray tube further includes a neck unit housing an electron gun for emitting three electron beams and a funnel unit for joining the panel unit and the neck unit. The panel unit has a diagonal diameter of not more than 52 cm and an effective display area on an outer face of the panel unit has a diagonal radius of curvature of not less than 1,300 mm. The dot trios of the fluorescent material are horizontally arrayed in a number of approximately at least 1600, and a cover film is applied to the panel unit to lower optical transmittance.

47 Claims, 6 Drawing Sheets

COLOR CATHODE RAY TUBE WITH COVER FILM ON PANEL UNIT

CROSS REFERENCE TO RELATED APPLICATION

This is a continuation of U.S. application Ser. No. 09/443,304, filed Nov. 19, 1999, now U.S. Pat. No. 6,114,803, which is a continuation of U.S. application Ser. No. 09/018,311, filed Feb. 3, 1998, now U.S. Pat. No. 6,140,756, the subject matter of which is incorporated by reference herein.

BACKGROUND OF THE INVENTION

The present invention relates to a color cathode ray tube and, more particularly, to a color cathode ray tube having a high resolution and an external size suited for use as a display monitor of the desktop size.

The color cathode ray tube is frequently employed as a TV receiver and as a display monitor for various information terminals, such as personal computers or workstations. In particular, the cathode ray tube for a color display monitor of the so-called "desktop terminal" type, such as a personal computer to be mounted on a desk for use by a user, is required to have a display performance of high resolution on a large screen and to be mounted compactly in a restricted space.

At present, the typical large size color cathode ray tube to be used as a display monitor of a desktop terminal of this kind is the 17 type (the effective display area of which has a diagonal size of about 41 cm) and the 21 type (with a diagonal size of about 51 cm). The 17 type color display monitor has a display performance of 1.3 M pixels. For a higher resolution, the 21 type color display monitor is used (which has a display performance of 2 M pixels: a horizontal dot number of not less than 1,450/line, preferably 1,600/line).

From the point of view of size, the 21 type color display cathode ray tube has an overall length of more than 450 mm, so that the length of the display monitor exceeds 500 mm. On the other hand, the typical table or desk has a top which is as deep as about 700 mm. If the depth of the keyboard is 150 mm, and if the area for accommodating the hands of the user is as deep as 100 mm, the usability of the display monitor becomes undesirable, if it is to be employed in a desktop size terminal.

If the display resolution of 2 M pixels is to be realized in the screen size of a 20 type color display monitor (corresponding to a 20 type color cathode ray tube having a panel unit with a diagonal diameter of 52 cm) or less, on the other hand, the hole pitch of the shadow mask must be reduced, which causes a problem in that the allowance for adjusting the color purity is deteriorated. In order to compensate for this, the transmittance of the holes of the shadow mask has to be lowered, which causes a drop in the brightness of the color cathode ray tube. Moreover, the color irregularity at the central portion and the peripheral portion of the screen becomes so serious as to cause a practical problem in the image quality.

Thus, a display monitor employing the color cathode ray tube of the prior art does not have a resolution corresponding to 2 M pixels and is not able to meet the size requirements necessary for desktop use.

In this kind of color cathode ray tube, on the other hand, a glass material forming the panel unit of the color cathode ray tube is a so-called "tinted material" or "dark tinted material" for improving the contrast and preventing the reflection of incoming light. In addition, the glass panel unit of the color cathode ray tube of the prior art is thinner at the central portion of its effective display area and thicker at the corner portion thereof, and this thickness difference is 1.7 mm or more. This makes a luminance difference due to the optical transmittance difference of the glass between the central portion and the corner portion irregular, causing a deterioration in the image quality.

SUMMARY OF THE INVENTION

An object of the invention is to solve the aforementioned several problems of the prior art and to provide a color cathode ray tube which has a resolution corresponding to 2 M pixels for a screen size of 20 type or less, but which has no irregularity in the display luminance and which can be adopted for use in a desktop terminal.

In order to achieve the above-specified object, the invention sets the size of the screen and the entire length of a color cathode ray tube for realizing the display performance of 2 M pixels (e.g., a horizontal dot number of 1,450/line or more, preferably 1,600/line) for the so-called "19 type size".

According to a first aspect of the invention, more specifically, there is provided a color cathode ray tube comprising a vacuum enclosure including: a panel unit having a fluorescent film formed on its inner face in the form of densely arrayed three color dot trios of a fluorescent material, with a shadow mask being mounted in the vicinity of the fluorescent film; a neck unit housing an electron gun for emitting three electron beams; and a funnel unit for jointing the panel unit and the neck unit; wherein, the panel unit has a diagonal diameter of not more than 52 cm, the effective display area on the outer face of the panel unit has a diagonal radius of curvature of not less than 1,000 mm, and the dot trios of the fluorescent material are horizontally arrayed in a number not less than 1,450 (preferably 1,600).

According to a second aspect, the diagonal radius of curvature is not less than 1,300 mm.

According to a third aspect, the diagonal diameter is not less than 49 cm and not more than 50 cm.

According to a fourth aspect, the diagonal diameter of the effective display area of the panel unit is not more than 482 mm, and wherein the radius of curvature of the corner portion of the effective display area is not more than 5 mm.

According to a fifth aspect, the radius of curvature of the corner portion of the effective display area is not more than 3 mm.

According to a sixth aspect, the difference (Td–To) is not more than 1.7 mm if the center portion of the effective display area of the panel unit has a thickness To and if the diagonal end portion of the effective display area has a thickness Td.

According to a seventh aspect, the difference (Td–To) is not more than 1.5 mm.

According to an eighth aspect, the panel unit is made of a tinted glass material.

According to a ninth aspect, the panel unit is made of a dark tinted glass material.

According to a tenth aspect, a cover film having at least one of an antistatic effect and an antireflection effect is formed on the outer surface of the panel unit, and wherein the green spectrum of the cover film has an optical absorptivity of 10 to 20%.

According to an eleventh aspect, the optical absorptivity of the green spectrum is 14 to 16%.

According to a twelfth aspect, the dot trios of the fluorescent material has a horizontal pitch not more than 0.22 mm.

According to a thirteenth aspect, three electron beams to be emitted from the electron gun have a mutual spacing not more than 5.5 mm.

According to a fourteenth aspect, three electron beams to be emitted from the electron gun have a mutual spacing not more than 5.0 mm.

According to a fifteenth aspect, a plurality of electrodes forming the main lens of the electron gun have an outer circumference shared among the three electron beams at their confronting portions.

According to a sixteenth aspect, the electron gun is a dynamic focus type electron gun having an electrostatic quadruplex lens.

According to a seventeenth aspect, the electron gun is a dynamic focus type electron gun having a plurality of electrostatic quadruplex lenses.

By the aforementioned individual aspects of the invention, the color cathode ray tube can be given an overall length of about 420 mm, so that the monitor will have a length of about 450 mm for a convenient desktop size, and the cathode ray tube can realize a display performance matching 2 M pixels (having a horizontal dot number of 1,450/line or more, preferably 1,600/line).

DETAILED DESCRIPTION OF THE PREFERRED EMBODIMENTS

The invention will be described in detail in connection with various embodiments.

Figure 1:
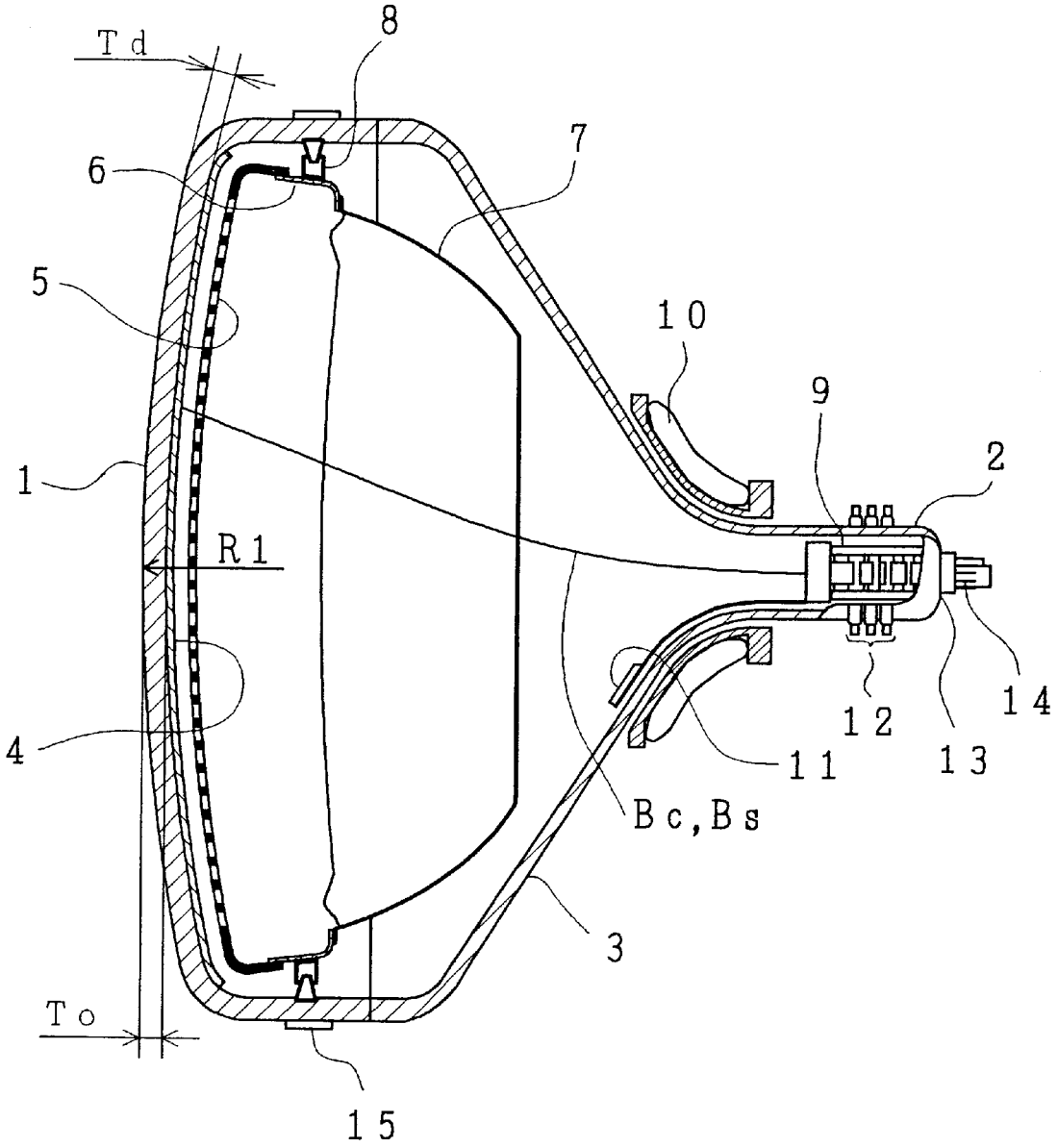
FIG. 1 is a section taken in the axial direction of a color cathode ray tube according to one embodiment of the invention.

FIG. 1 is a section taken in the axial direction of a color cathode ray tube according to one embodiment of the invention. The cathode ray tube includes a panel unit 1; a neck unit 2; a funnel unit 3; a fluorescent film 4; a shadow mask 5; a mask frame 6; a magnetic shield 7; a mask suspending mechanism 8; an electron gun 9; a deflection yoke 10; a getter 11; an external correction magnet 12; a stem 13; stem pins 14; and an implosion band 15.

The panel unit 1 is coated on its inner surface with the fluorescent film 4 in which fluorescent dots of red, green and blue colors are densely arrayed, and the shadow mask 5, or other color selecting electrode, is arranged in the vicinity of the fluorescent film. The shadow mask 5 is held by the mask frame 6, which is suspended at three or four portions of its outer circumference by the mask suspending mechanism 8. This mask suspending mechanism is retained by stud pins 14 which are anchored on the inner face of the skirt portion of the panel unit. To this mask, moreover, there is attached the magnetic shield 7 for shielding the electron beams Bc and Bs×2 (Bc: a center beam, and Bs: side beams) from an external magnetic field, such as the earth's magnetism.

In the neck unit 2, there is housed the electron gun 9 for emitting three electron beams to the fluorescent film. This electron gun 9 is fed with image signals, focusing voltages and other voltages from the plural stem pins 14 which protrude outward from the stem 13. On the outer circumference of the neck portion, on the other hand, there is mounted the external correction magnet 12 for correcting the centering or color impurity of the electron beams.

On the transition region of the funnel 3, which joins the neck unit 3 and the panel unit 1, into the neck unit 2, moreover, there is mounted the deflection yoke 10 for reproducing an image by deflecting the electron beams, emitted from the electron gun 9, in horizontal and vertical directions to scan the fluorescent film two-dimensionally.

Figure 2:
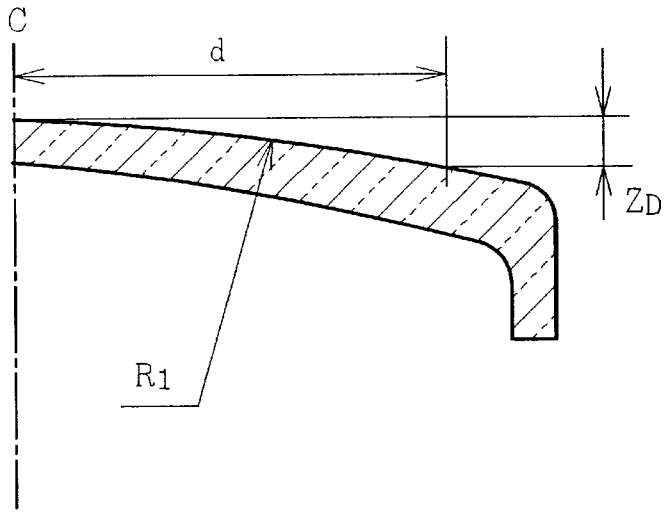
FIG. 2 is a section of a portion of the color cathode ray tube panel unit shown in FIG. 1 according to the invention.

FIG. 2 is a section of a portion of the panel unit of the color cathode ray tube shown in FIG. 1 according to the invention. The diagonal radius R1 of curvature of the effective display area of the outer face of the panel unit 1 is not less than 1,000 mm, preferably not less than 1,300 mm. Here, when the diagonal radius R1 of curvature is not a single radius, it can be equivalently expressed by R1=(d2+ZD2)/2ZD, if half of the diagonal diameter of the effective display area is designated by d, and if the axial height from the diagonal end of the effective display area to the center C is designated by ZD, as shown in FIG. 2.

Figure 3:
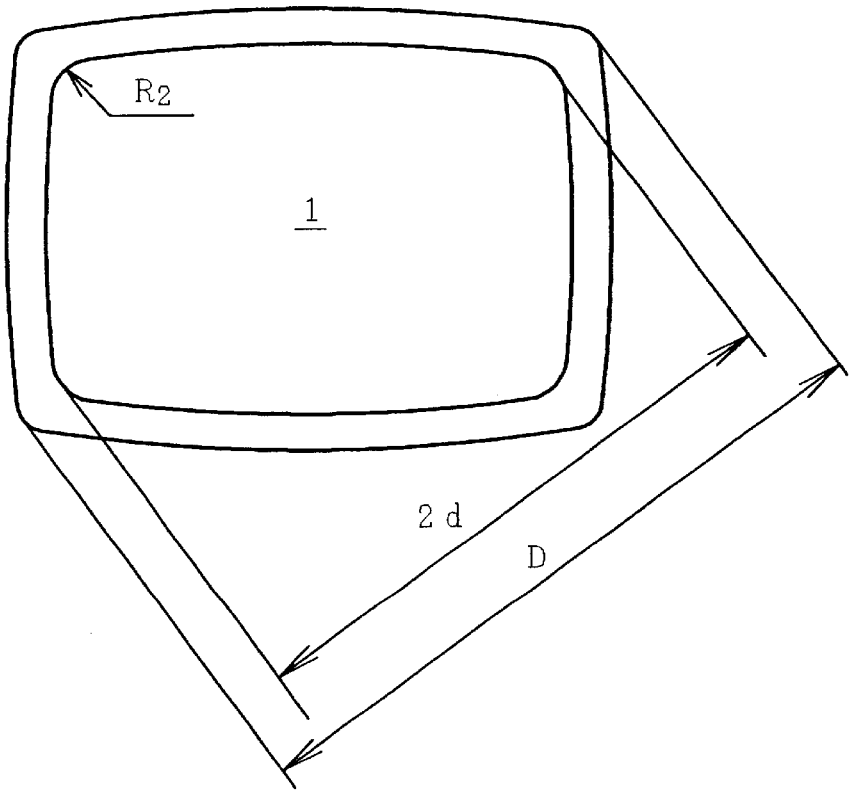
FIG. 3 is a front elevation of the panel unit of the color cathode ray tube according to the invention.

FIG. 3 is a front elevation showing one example of the panel unit of the color cathode ray tube according to the invention, as shown in FIG. 1. The diagonal length (or external diameter) D of the panel unit 1 is not more than 52 cm, preferably not less than 49 cm and not more than 50 cm, and the diagonal diameter 2d of the effective display area of the panel unit 1 is 48.2 cm, for an external diameter D of 52 cm of the panel unit, and is 45.6 to 46.5 cm, for an external diameter D of 49 to 50 cm. Moreover, the radius R2 of curvature of the corner portion of the effective display area is not more than 5 mm, preferably not more than 3 mm. With this radius of curvature of the corner portion, the effective display region can be enlarged to realize a monitor of large screen size.

In order to improve the contrast of the displayed image of a color cathode ray tube for use as a display monitor, the glass material (i.e., the so-called "panel glass") making up the panel unit 1 is exemplified by a tinted material having a low optical transmittance, e.g., about 50% or a dark tinted material having a transmittance of about 40%. If there is a difference in the thickness of the panel glass in this case between the central portion and the peripheral portion of the whole face (or face plate) of the panel unit, a serious difference occurs in the brightness on the display screen so that the luminance appears irregular. Especially, when the transmittance of the holes of the shadow mask becomes low, such as in a highly fine color cathode ray tube, the luminance irregularity becomes more apparent.

In the embodiment of the invention, therefore, the thickness difference (Td–To) of the glass between the central portion and the diagonal end portion is set to 1.4 mm, if the glass forming the panel unit 1 has a thickness To at the central portion of the effective display area of the panel unit and a thickness of Td at the diagonal end portion. Here, the thickness difference (Td–To) is desired to be not more than 1.7 mm, preferably not more than 1.5 mm. By this thickness, the difference in the brightness between the central portion and the diagonal end portion of the panel unit 1 is reduced to make the irregularity of the display luminance less apparent, thereby to form a display image of high quality.

Figure 4:
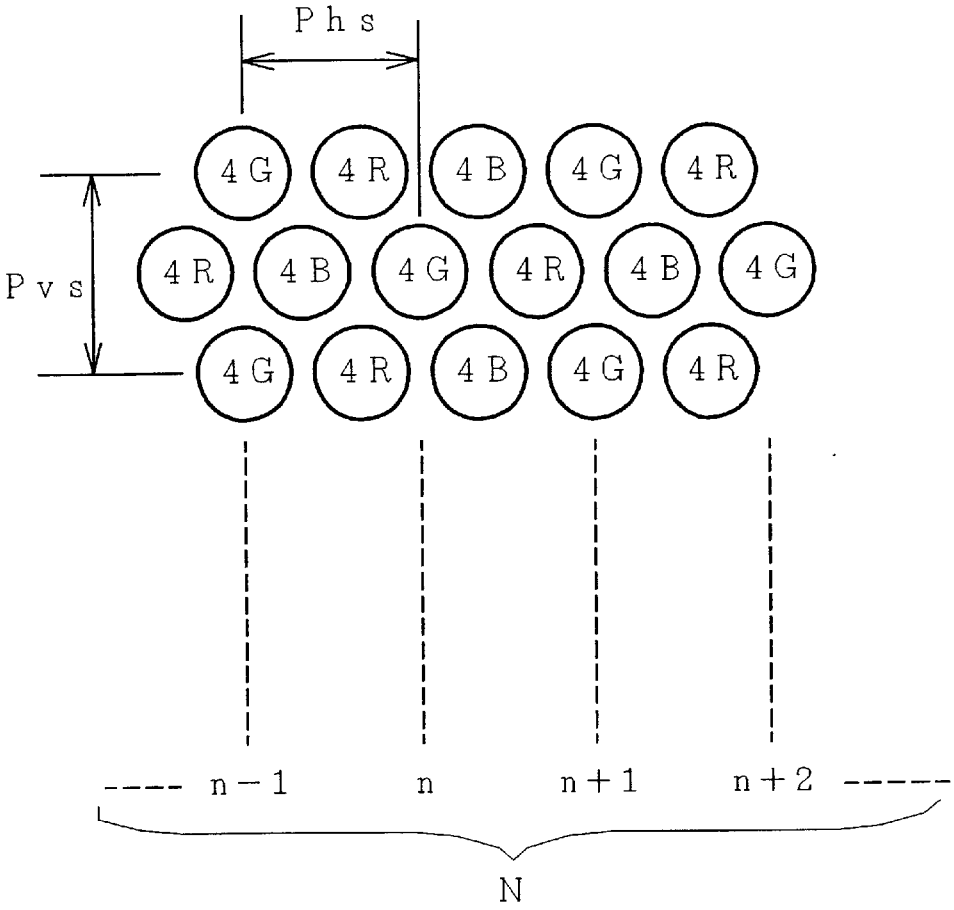
FIG. 4(*a*) is a diagram showing an array size of fluorescent dots formed in the panel unit of the color cathode ray tube according to the invention, and FIG. 4(*b*) is a diagram showing the array size of dot holes of a shadow mask of the color cathode ray tube according to the invention.
Figure 4:
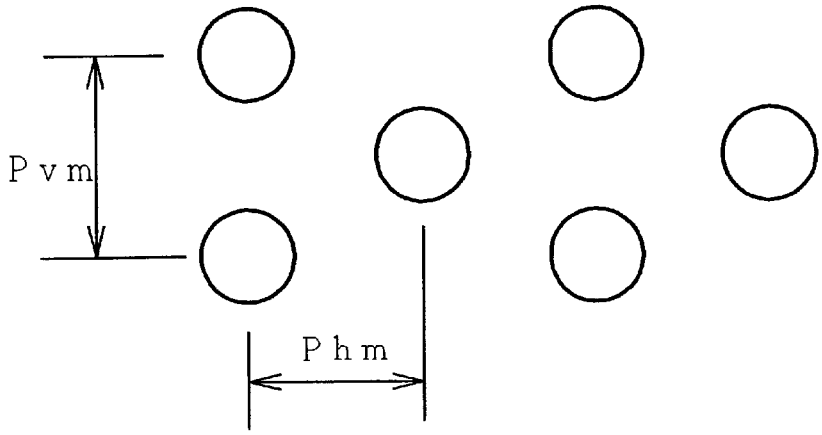

FIG. 4(*a*) shows the array size of fluorescent dots, as formed in the panel unit of the color cathode ray tube according to the invention shown in FIG. 1, and FIG. 4(*b*) shows the size of the apertures of the shadow mask. As shown in FIG. 4(*a*), the fluorescent screen has fluorescent dots 4R, blue fluorescent dots 4B and green fluorescent dots 4G, and these dots 4R, 4B and 4G are grouped, to form a plurality of "dot trios". In this regard, numerals n−1, n, n+1, n+2, - - - designate the number N of dot trios arrayed in the horizontal direction, and this array number is not less than 1,450/line, preferably 1,600/line. By this array number, it is possible to achieve a display performance of high resolution corresponding to the aforementioned value of 2 M pixels.

In order to realize a display resolution corresponding to 2 M pixels for a panel unit having a diagonal diameter of not less than 52 cm and a diagonal diameter of the effective display area of not more than 48.2 cm, the fluorescent dot trios of the fluorescent film are given a horizontal array pitch Phs of 0.22 mm and a vertical array pitch Pvs of 0.29 mm, and the dot holes of the corresponding shadow mask are given a horizontal array pitch Phm of 0.21 mm and a vertical array pitch Pvm of 0.28 mm.

Thus, the color purity characteristics become harder to maintain for the smaller array pitches of the fluorescent dot trios and the dot holes of the shadow mask. In order to compensate for this, it is necessary to reduce the ratio of the size (or hole diameter) of the dot holes to the array pitch of the dot holes of the shadow mask. Unfortunately, this lowers the brightness of the displayed image to cause a color irregularity due to the luminance difference between the central portion and the peripheral portion of the screen.

In the embodiment of the invention, therefore, the appearance of the luminance irregularity, which might otherwise accompany a drop in the brightness, can be eliminated by suppressing the difference in the thickness of the glass forming the panel unit 1 between the central portion and the peripheral portion of the effective display area of the panel unit 1. However, when the panel glass is exemplified by a material, such as a dark tinted material having an especially low optical transmittance, however, the irregularity may still arise in the display luminance, even if the difference in the thickness of the panel glass is suppressed between the central portion and the peripheral portion of the effective display area of the panel unit 1, as described above.

Figure 5:
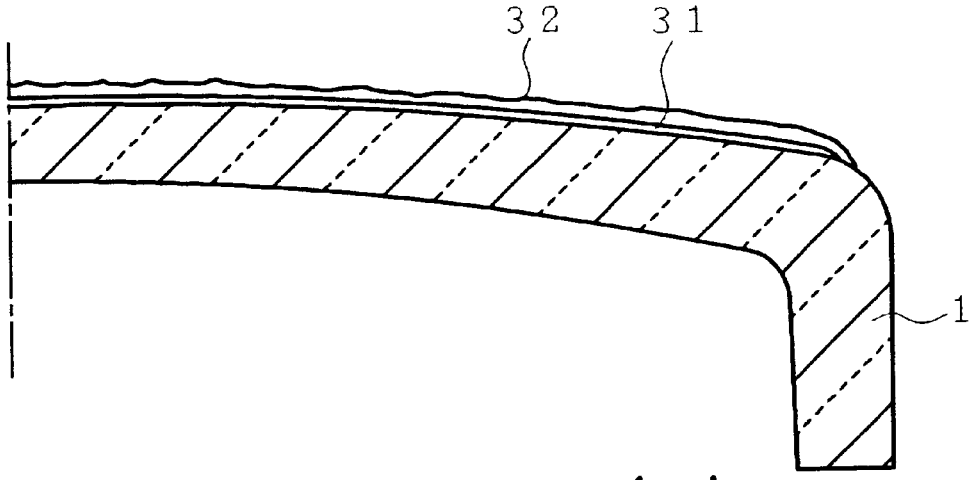
FIGS. 5(*a*), 5(*b*) and 5(*c*) are sections of portions of various examples of the panel unit of the color cathode ray tube according to the invention.
Figure 5:
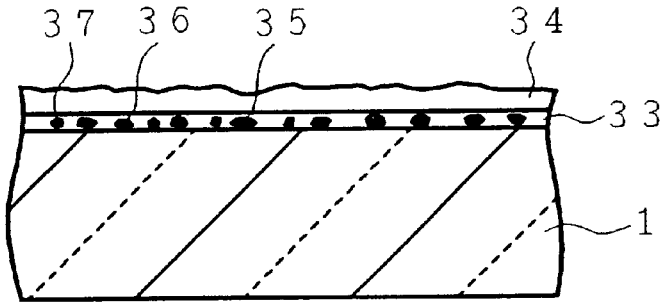
Figure 5:
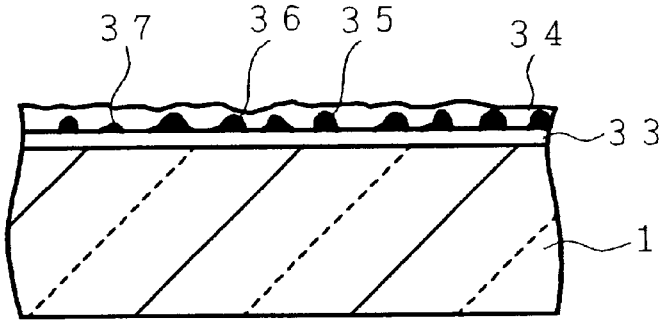

FIGS. 5(*a*) to 5(*c*) represent sections of portions of explaining various examples of the panel unit of the color cathode ray tube according to the invention. For the purpose of shielding glare and preventing reflection and a static charge of the panel unit, as shown in FIG. 5(*a*), there is formed on the outer surface of the panel unit 1 a surface treating cover film which is formed of an antistatic film 31 and an antireflection film 32.

As shown in FIGS. 5(*b*) and 5(*c*), moreover, there is homogeneously dispersed in the surface treating cover film a material, such as carbon black or a pigment for lowering the optical transmittance. Unlike the glass, a surface treating cover film of this kind can be homogeneously applied to the outer face of the panel unit 1 so that the optical transmittance can be made generally constant all over the screen, to solve the problem of luminance irregularity on the display screen due to the transmittance difference of the glass making up the panel portion 1, to a range where there is no problem.

As shown in FIG. 5(*b*), a transparent conductive film 33 having an antistatic effect is formed over the outer surface of the panel unit 1, and a silica film 34 having an antireflection effect and a rough surface structure is formed over the transparent conductive film 33. Into this transparent conductive film 33, moreover, there are dispersed a blue pigment 36 and a violet pigment 37 in addition to carbon black 35. These pigments are used because use of only carbon black may deviate the optical absorption spectrum to make the whole display screen so yellow as to annoy the observer of the image. Depending upon the environment of use, such as the application or the position of the color display monitor, the specifications of the pigments to be dispersed in the transparent conductive film may naturally be modified to meet the demand (or taste) of the viewer as to the color tones of the image.

As shown in FIG. 5(*c*), the dispersed layer of the carbon black 35, the blue pigment 36 and the violet pigment 37 may be formed between the transparent conductive film 33 and the 13 silica film 34. Specifically, the transparent conductive film 33 having an antistatic effect is formed over the outer surface of the panel unit 1, and the dispersed layer of the carbon black 35, the blue pigment 36 and the violet pigment 37 is formed over the transparent conductive film 33. This dispersed layer is overlaid by the silica film 34, having a glare shielding property, antireflection effects and a rough surface. Here, the carbon black 35, the blue pigment 36 and the violet pigment 37 may be dispersed either in the silica film 34, or both in the transparent conductive film 33 and the silica film 34. Alternatively, the carbon black 35, the blue pigment 36 and the violet pigment 37 may be individually dispersed either in the transparent conductive film 33 and the silica film 34, or between them, since their arrangement is arbitrary.

By this structure of the panel unit surface, the effect to suppress luminance irregularity is achieved, in addition to antistatic and antireflection effects. Here, in the aforementioned structure of the panel unit, the absorption of the optical transmittance by the surface treating cover film is 14 to 16%, but this optical absorptivity by the surface treating cover film may be changed depending upon the glass material making up the panel unit 1. However, this optical absorptivity preferably resides within a range of 10 to 20% from the standpoint of the dispersion of the manufacturing process.

Figure 6:
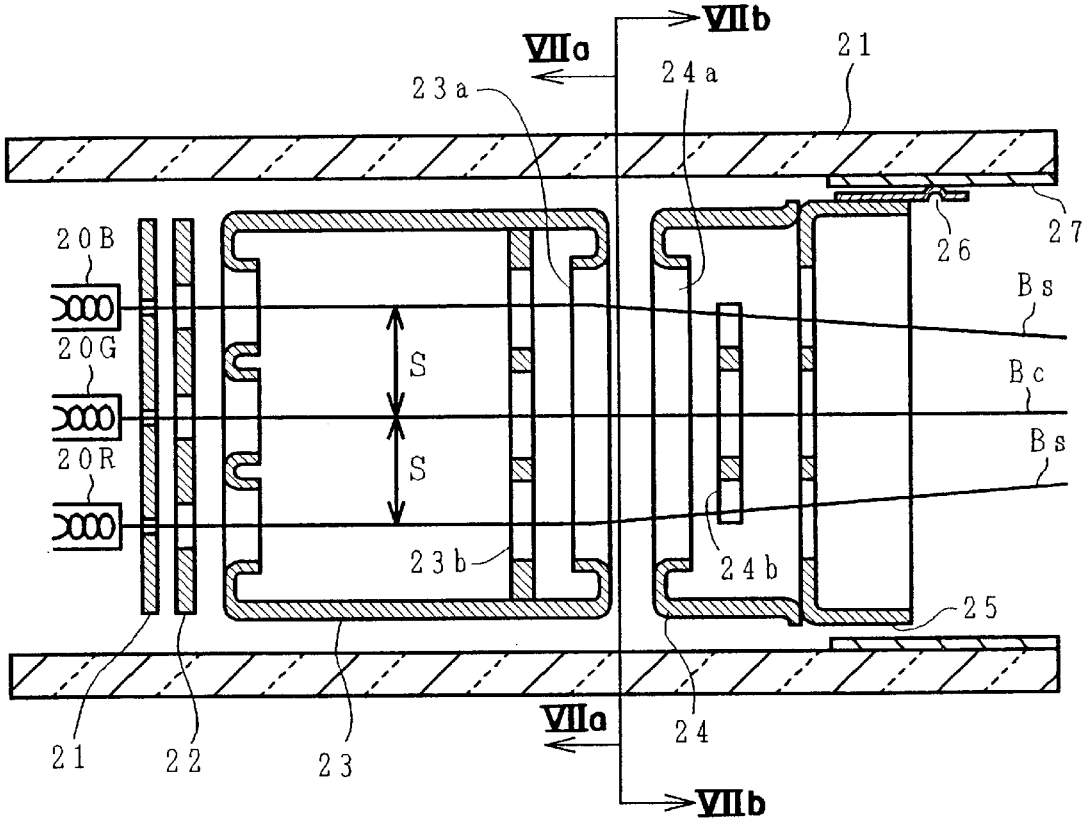
FIG. 6 is a section, taken along a horizontal axis, of one example of an electron gun to be housed in a neck portion of the color cathode ray tube according to the invention.

FIG. 6 is a section taken along a horizontal axis showing one example of an electron gun which may be housed in a neck portion of the color cathode ray tube according to the invention, as shown in FIG. 1. The electron gun includes cathodes 20B, 20G and 20R; a first electrode 21; a second electrode 22; a third electrode 23; a fourth electrode 24; a shield cup 25; an opening portion 23*a* of the third electrode at the side of the fourth electrode; a correction electrode 23*b* arranged in the third electrode; an opening portion 24*a* of the fourth electrode at the side of the third electrode; a correction electrode 24*b* arranged in the fourth electrode; and a contact spring 26 in contact with a conductive film 27 applied to the inner wall of the neck unit.

In this electron gun, the three cathodes 20B, 20G and 20R, corresponding to the three colors, and the first electrode 21 and the second electrode 22 form a so-called "three-pole unit", and a main lens is formed on the confronting faces of the third electrode 23, acting as a focusing electrode and the fourth electrode 24, acting as an acceleration electrode.

In the third electrode 23, the correction electrode 23*b* is arranged at a position which is retracted from the single aperture 23*a* formed in the face confronting the fourth electrode 24 for passing the three electron beams therethrough. In the fourth electrode 24, on the other hand, the correction electrode 24*b* is arranged at a position which is retracted from the single aperture 24*a* formed in the face confronting the third electrode 23 for passing the three electron beams therethrough.

Figure 7:
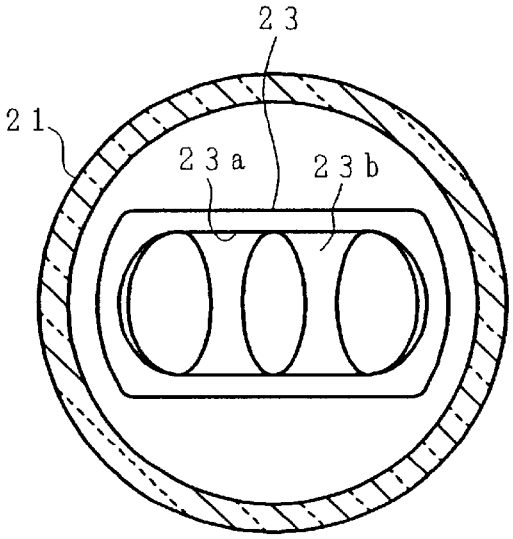
FIGS. 7(*a*) and 7(*b*) are front elevations, taken along lines A—A and B—B, respectively, in FIG. 6, of a main lens portion of a large-aperture electron gun to be used in the color cathode ray tube according to the invention.
Figure 7:
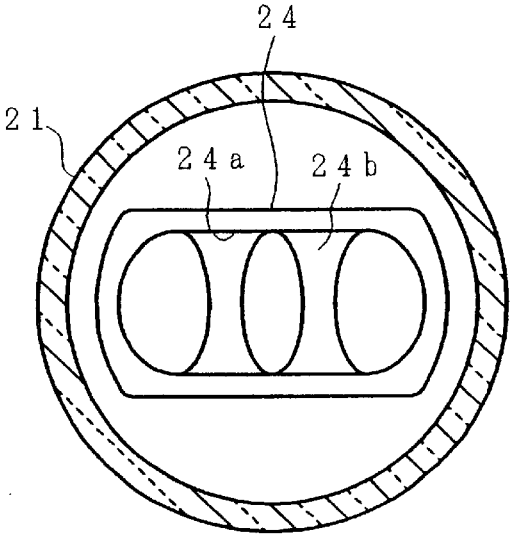

FIGS. 7(*a*) and 7(*b*) show front elevations of the main lens portions to be formed by the third electrode 23 and the fourth electrode 24, wherein the third electrode is seen in FIG. 7(*a*), as viewed along line A—A of FIG. 6, and the fourth electrode is seen in FIG. 7(*b*), as viewed along line B—B in FIG. 6. As shown in FIG. 7(*a*), the third electrode 23 has the single opening 23*a* formed in its common outer circumferential wall in the face confronting the fourth electrode 24, and the correction electrode 23*b* is mounted behind the opening 23*a*. Likewise, the fourth electrode 24 has the single opening 24*a* formed in its common outer circumferential wall in the face confronting the third electrode 23, and the correction electrode 24*b* is mounted behind the opening 24*a*.

These correction electrodes perform a so-called "field curvature correction" and "astigmatism correction", and the single apertures 23*a* and 24*a* substantially form a main lens having a large aperture. By using an electron gun having that large-aperture main lens shared among the three electron beams, the spacing (or S value) between the three electron beams to pass through the main lens of the electron gun can be minimized, thereby to improve the focusing characteristics.

In the highly fine color cathode ray tube to which the invention is directed, on the other hand, the hole pitch (i.e., the dot hole pitch) of the shadow mask has to be set to a small value so as to improve the display resolution. As the hole pitch of the shadow mask is made small, the spacing between the shadow mask and the fluorescent film is necessarily reduced to cause the three fluorescent dot trios to be arranged equidistantly. At the step of applying the fluorescent film in the process of manufacturing the color cathode ray tube, therefore, the workability of mounting/demounting the panel unit and the shadow mask is lowered, that is, the time period, as required for the mounting/demounting operations so as to keep the shadow mask out of contact with the fluorescent film, is elongated to raise the problem of reduction in the production yield.

In the embodiment of the invention, therefore, the aforementioned electron gun having a large-aperture main lens shared among the three electron beams is combined with a highly fine shadow mask, so that the spacing S among the three electron beams can be minimized. As a result, the distance Q between the shadow mask and the fluorescent film is accordingly enlarged to improve not only the focusing characteristics, but also the mounting/demounting workability of the shadow mask in the fluorescent film applying process, thereby improving the production yield.

In the aforementioned embodiment of the invention, the spacing S among the three electron beams is set to a smaller value of 5.5 mm than the external diameter of 29 mm of the neck unit 2, although the horizontal array pitch Phm of the dot holes of the shadow mask is made as small as 0.21 mm to achieve an image display of high resolution. As a result, satisfactory focusing characteristics can be achieved on the display screen without deteriorating the mounting/demounting workability of the shadow mask in the process of manufacturing the color cathode ray tube. If the spacing S among the three electron beams is 5.0 mm or less, moreover, the horizontal pitch Phm of the dot holes of the shadow mask can be 0.20 mm or less to form a super-fine image having a further improved display resolution.

If the display screen is flat, the visibility is improved to enhance the apparent resolution. In the aforementioned embodiment of the invention, the diagonal radius of curvature R1 of the outer face of the panel unit 1 is 300 mm or more, so that the radius of curvature R1 is made larger than that of the panel of the prior art (having a screen of 1 R) to provide a so-called "2-R screen" approximating a flat screen. If this screen is flattened, however, the focusing characteristics become even more different, between the central portion and the peripheral portion, than those of the display screen of the prior art. For compensating for this difference in the focusing characteristics, it is desirable to use an electron gun of the type to be described in the following.

Figure 8:
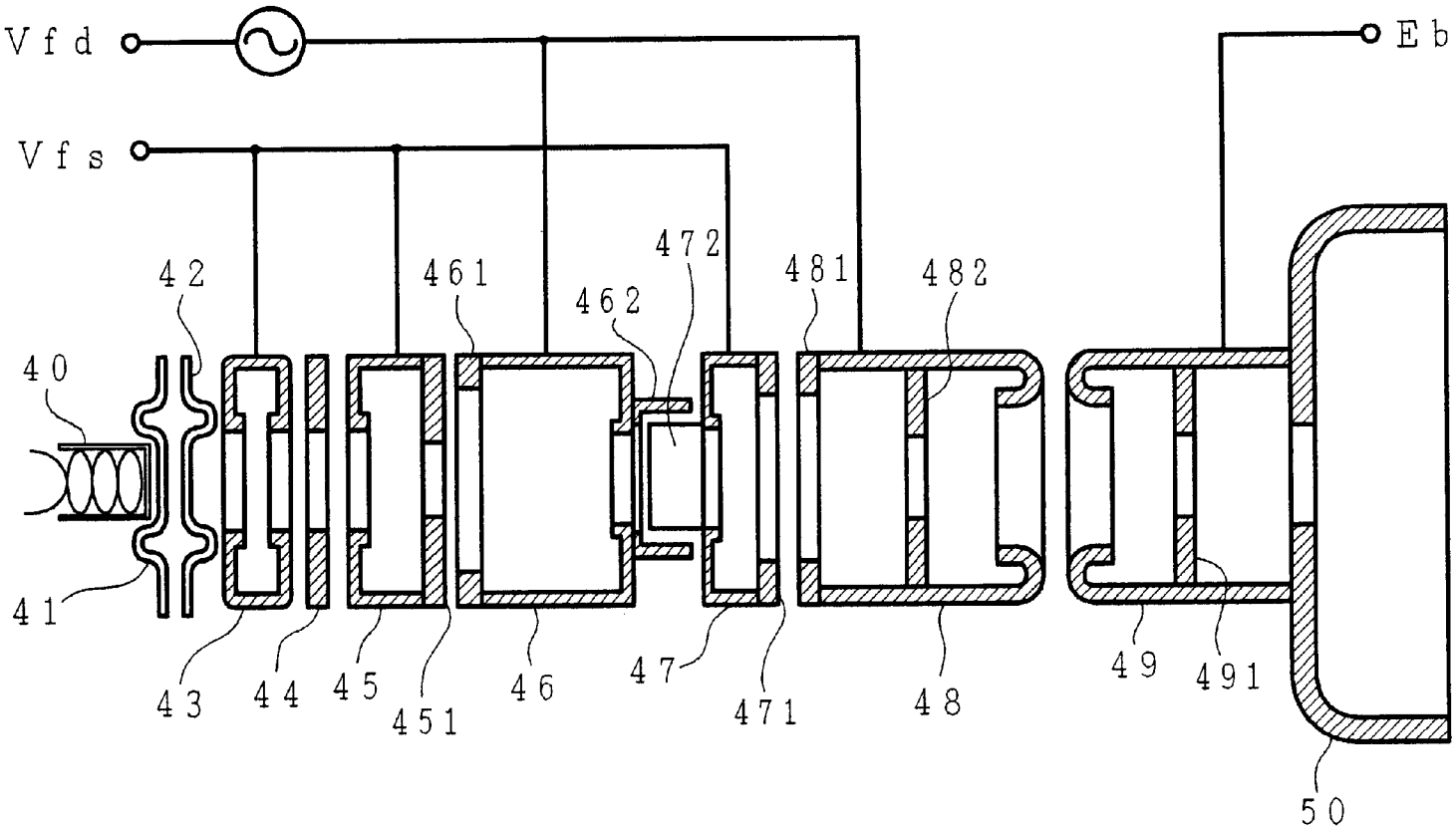
FIG. 8 is a section, taken along a vertical axis, of another type of the electron gun to be used in the color cathode ray tube according to the invention.

FIG. 8 is a section taken along a vertical axis for explaining another type of the electron gun to be used in the color cathode ray tube according to the invention. This electron gun includes a cathode 40; a first electrode 41; a second electrode 42; a third electrode 43; a fourth electrode 44; a fifth electrode 45; a sixth electrode 46; a seventh electrode 47; an eighth electrode 48; a ninth electrode 49; and a shield cup 50.

In the electron gun, an electrode plate 451 is arranged at the side, which confronts the sixth electrode 46, of the fifth electrode 45 and has three electron beam passing holes; an electrode plate 461 is arranged at the side, which confronts the fifth electrode 45, of the sixth electrode 46 and has three electron beam passing holes. The electron gun further includes horizontal correction plates 462 and a vertical correction plate 472. Further, electrode plates 471 and 481 are arranged at the sides confronting the seventh electrode 47 and the eighth electrode 48, respectively, and have three electron beam passing holes; and correction plates 482 and 491 are arranged in the eighth electrode 48 and the ninth electrode 49, respectively.

In FIG. 8, the cathode 40, the first electrode 41 and the second electrode 42 form a first electrode means, i.e., a so-called "three-pole unit"; the third electrode 43 to the ninth electrode 49 form second electrode means for focusing/accelerating the electron beams; and the eighth electrode 48 and the ninth electrode 49 form the main lens inbetween.

To the ninth electrode 49, acting as an acceleration electrode, there is applied the maximum voltage (or anode voltage) Eb so that the main lens, formed by it and the eighth electrode 48, acts to focus the electron beams more intensely in the horizontal direction than in the vertical direction.

A constant voltage Vfs is applied as a first focusing voltage to the third electrode 43, the fifth electrode 45 and the seventh electrode 47, and a second focusing voltage Vfd, produced by superimposing a dynamic voltage rising with the increase in the deflection of the electron beams to a constant voltage, is applied to the sixth electrode 46 and the eighth electrode 48.

The electrode plates 471 and 481, arranged at the confronting sides of the eighth electrode 48 and the seventh electrode 47, have a first kind of electron lens formed to have three electron beam passing holes acting as a field curvature correcting lens. These electron beam passing holes may be formed into any of a circular shape, or a rectangular, elliptical or key-hole shape, having a longer axis in the vertical direction.

Specifically, this first kind of electron lens is weakened in its power to form the aforementioned field curvature correcting lens by raising the aforementioned dynamic voltage in accordance with an increase in the deflections of the electron beams.

In the seventh electrode 47, at the side of the sixth electrode 46, there are formed circular electron beam passing holes for passing the three electron beams individually. At the horizontal side portions of these individual electron beam passing holes, there are arranged the plural vertical correction plates 472 which are extended toward the sixth electrode 46 so as to interpose the individual electron beams in the horizontal direction. In the sixth electrode 46, at the side of the seventh electrode 47, there is formed a single opening for passing the three electron beams commonly therethrough. At the vertical side of the single opening, there are arranged the paired horizontal plates 462 which interpose the three electron beams in the vertical direction. A second kind of electron lens acting as an astigmatism correcting lens is formed between the seventh electrode 47 and the sixth electrode 46.

The second focusing voltage Vfd, which is obtained by superimposing a dynamic voltage on a constant voltage as the deflection in the electron beams increases, is applied to the sixth electrode 46 and the constant voltage Vfs, which is higher than the voltage to be applied to the sixth electrode 46, is applied to the seventh electrode 47. As a result, the aforementioned second kind of electron lens exerts a focusing action in the vertical direction and a diverging action in the horizontal direction to the individual electron beams.

The actions of this second kind of electron lens reach a maximum, when the electron beams are not deflected, that is, when the electron beams form a spot at the center of the screen to offset the stronger focusing actions in the horizontal direction than those in the vertical direction produced by the main lens, and become a minimum at the corner of the screen when the electron beams are deflected.

In the sixth electrode 46, at the side of the fifth electrode 45, there are formed electron beam passing holes which have any of a circular shape, or a rectangular, elliptical or key-hole shape, having a longer axis in the vertical direction for passing the three electron beams individually. In the fifth electrode 45, at the side of the sixth electrode 46, there are formed electron beam passing holes which have any of a circular shape, or a rectangular, elliptical or key-hole shape, having a longer axis in the horizontal direction for passing the three electron beams individually. These portions form a third kind of electron lens acting as an electron beam shape correction lens. on the other hand, the second focusing voltage Vfd, as prepared by superimposing a dynamic voltage rising with an increase in the deflection of the electron beam on a constant voltage, is applied to the sixth electrode 46, and the constant voltage Vfs, which is higher than the voltage to be applied to the sixth electrode 46, is applied to the fifth electrode 45. As a result, the aforementioned third kind of electron lens exerts a focusing action in the vertical direction and a diverging action in the horizontal direction on the individual electron beams.

The actions of this third kind of electron lens reach a maximum when there is no deflection, that is, when the spot is formed at the screen center, and the second kind electron lens exerts a focusing action in the vertical direction and a diverging action in the horizontal direction so that the electron beam is incident on the main lens always with a sectional shape approximating a circle.

In the electron gun having the structure thus far described in the foregoing embodiment, therefore, with no deflection, the electron beam emanating from the first electrode means is constrained in its horizontal diameter by the third kind of electron lens, so that it enters the second kind of electron lens with a vertically elongated section. The electron beam is intensely focused in the vertical direction by the second kind of electron lens in the horizontal direction by the third kind of electron lens so that it enters the main lens with a sectional shape approximating a circle.

The electron beam having entered the main lens is intensely focused in the vertical direction so that its intense divergence in the horizontal direction is offset by a focusing action, which is so established by the main lens as to be more intense in the horizontal direction than in the vertical direction.

Since the relation of the first focusing voltage Vfs the second focusing voltage Vfd at the maximum deflection time, moreover, the second kind of electron lens and the third kind of electron lens hardly act, and the electron beam which has left the first electrode means enters the main lens with a sectional shape approximating a circle, so that it is focused more intensely in the horizontal direction than in the vertical direction by the main lens. The electron beam thus focused more intensely in the horizontal direction than in the vertical direction by the main lens is influenced by the deflection errors, which are caused by a pin cushion magnetic field and a barrel magnetic field, acting midway from the main lens to the screen. As a result, the focusing action, which is more intense in the vertical direction than in the horizontal direction, is offset by the focusing action which is so established by the main lens as to be more intense in the horizontal direction than in the vertical direction.

Here, the eighth electrode 48 forming the main lens has a single opening formed in its common outer circumferential wall in the face confronting the ninth electrode 49, and the correction electrode 482 is mounted behind this opening. Likewise, the ninth electrode 49 has a single opening formed in its common outer circumferential wall in the face confronting the eighth electrode 48, and the correction electrode 491 is mounted behind this opening. These correction electrodes perform a so-called "astigmatism correction", and the single apertures substantially form a main lens having a large aperture.

In this electron gun as thus far described, the first kind of electron lens, the second kind of electron lens and the third kind of electron lens are arrayed in the recited order in the direction from the main lens to the first electrode means so that a beam spot shape having a substantially equal vertical diameter is achieved all over the screen whether the electron beam is deflected or not. Moreover, a two electrostatic quadruplex pole lens is formed of the second kind of electron lens and the third kind of electron lens, so that the maximum lens aperture of the main lens can be utilized within a range where it experiences a sufficiently small influence due to spherical aberration, thereby reducing the beam spot diameter all over the screen area. As a result, a high resolution can be achieved all over the screen area.

By adopting the electron gun of this type in the color cathode ray tube described with reference to FIG. 1, too, the spacing (or S value) among the three electron beams to pass through the main lens of the electron gun can be minimized to improve the focusing characteristics.

Thus, according to the present embodiment, the entire length of the color cathode ray tube of the nominal size of 19 inches can be shortened to about 420 mm, and its resolution can be raised to about 1,600×1,280 lines corresponding to 2 M pixels.

As has been described hereinbefore, it is possible to provide a color cathode ray tube having a high resolution corresponding to 2 M pixels, but no irregular display luminance, and the cathode ray tube is capable of being produced with such a size that it can be used in a desktop terminal. Further, a luminance irregularity between the central portion and the corner portion of the effective display area can be prevented by reducing the difference in the thickness of the glass panel unit between the central portion and the corner portion thereof.

What is claimed is:

1. A color cathode ray tube comprising a vacuum enclosure including a panel unit having a fluorescent film formed on an inner face, said fluorescent film consisting of densely arrayed three color dot trios of a fluorescent material, a shadow mask being mounted in the vicinity of said fluorescent film, a neck unit housing an electron gun for emitting three electron beams, and a funnel unit for joining said panel unit and said neck unit, wherein said panel unit has a diagonal diameter of not more than 52 cm, wherein an effective display area on an outer face of said panel unit has a diagonal radius of curvature of not less than 1,300 mm, and wherein the dot trios of said fluorescent material are horizontally arrayed in a number of approximately at least 1600, and wherein a cover film is applied to said panel unit to lower optical transmittance.

2. A color cathode ray tube according to claim 1, wherein said cover film is applied to an outer surface of said panel unit.

3. A color cathode ray tube according to claim 1, wherein said cover film directly contacts a surface of said panel unit.

4. A color cathode ray tube according to claim 1, wherein said cover film includes carbon black material.

5. A color cathode ray tube according to claim 1, wherein said cover film includes pigment.

6. A color cathode ray tube according to claim 5, wherein said pigment includes a blue pigment.

7. A color cathode ray tube according to claim 5, wherein said pigment includes a violet pigment.

8. A color cathode ray tube according to claim 4, wherein said cover film further includes pigment.

9. A color cathode ray tube according to claim 1, wherein said cover film is homogeneously applied to said panel unit.

10. A color cathode ray tube according to claim 9, wherein said cover film is homogeneously applied to an outer surface of said panel unit.

11. A color cathode ray tube according to claim 1, wherein an optical absorption of said cover film in the green spectrum is 10% to 20%.

12. A color cathode ray tube according to claim 1, wherein an optical absorption of said cover film in the green spectrum is 14 to 16%.

13. A color cathode ray tube according to claim 2, wherein said cover film includes an electrical conductive layer and a silica layer.

14. A color cathode ray tube according to claim 2, wherein said cover film includes an electrical conductive layer and a silica layer, and wherein carbon black material is dispersed in said electrical conductive layer.

15. A color cathode ray tube according to claim 2, wherein said cover film includes an electrical conductive layer and a silica layer, and wherein pigment is dispersed in said electrical conductive layer.

16. A color cathode ray tube according to claim 14, wherein said electrical conductive layer further includes pigment.

17. A color cathode ray tube according to claim 1, wherein a panel glass of said panel unit includes tinted material.

18. A color cathode ray tube according to claim 1, wherein said panel unit has a diagonal diameter of not more than 50 cm.

19. A color cathode ray tube according to claim 18, wherein said cover film is applied to an outer surface of said panel unit.

20. A color cathode ray tube according to claim 18, wherein said cover film is homogeneously applied to said panel unit.

21. A color cathode ray tube comprising a vacuum enclosure including a panel unit having a fluorescent film formed on an inner face thereof, said fluorescent film consisting of densely arrayed three color dot trios of a fluorescent material, a shadow mask being mounted in the vicinity of said fluorescent film, a neck unit housing an electron gun for emitting three electron beams, and a funnel unit for joining said panel unit and said neck unit, wherein said panel unit has a diagonal diameter of not less than 49 cm and not more than 50 cm, wherein an effective display area on an outer face of said panel unit has a diagonal radius of curvature of not less than 1,300 mm, wherein the dot trios of said fluorescent material have a horizontal pitch of not more than 0.22, and wherein a cover film is applied to said panel unit to lower optical transmittance.

22. A color cathode ray tube according to claim 21, wherein said cover film is applied to an outer surface of said panel unit.

23. A color cathode ray tube according to claim 21, wherein said cover film includes carbon black material.

24. A color cathode ray tube according to claim 21, wherein said cover film includes pigment.

25. A color cathode ray tube according to claim 21, wherein said cover film is homogeneously applied to said panel unit.

26. A color cathode ray tube according to claim 21, wherein an optical absorption of said cover film in the green spectrum is 10% to 20%.

27. A color cathode ray tube according to claim 21, wherein an optical absorption of said cover film in the green spectrum is 14 to 16%.

28. A color cathode ray tube comprising a vacuum enclosure including a panel unit having a fluorescent film formed on an inner face thereof, said fluorescent film consisting of densely arrayed three color dot trios of a fluorescent material, a shadow mask being mounted in the vicinity of said fluorescent film, a neck unit housing an electron gun for emitting three electron beams, and a funnel unit for joining said panel unit and said neck unit, wherein the diagonal diameter effective display area of said panel unit is not more than 465 cm, wherein the effective display area on an outer face of said panel unit has a diagonal radius of curvature of not less than 1,300 mm, and wherein the dot trios of said fluorescent material are horizontally arrayed in a number of approximately at least 1600, and wherein a cover film is applied to said panel unit to lower optical transmittance.

29. A color cathode ray tube according to claim 28, wherein said cover film is applied to an outer surface of said panel unit.

30. A color cathode ray tube according to claim 28, wherein said cover film includes carbon black material.

31. A color cathode ray tube according to claim 28, wherein said cover film includes pigment.

32. A color cathode ray tube according to claim 28, wherein said cover film is homogeneously applied to said panel unit.

33. A color cathode ray tube according to claim 28, wherein an optical absorption of said cover film in the green spectrum is 10% to 20%.

34. A color cathode ray tube according to claim 28, wherein said cover film includes an electrical conductive layer and a silica layer, and wherein carbon black material is dispersed in said electrical conductive layer.

35. A color cathode ray tube according to claim 28, wherein said cover film includes an electrical conductive layer and a silica layer, and wherein pigment is dispersed in said electrical conductive layer.

36. A color cathode ray tube comprising a vacuum enclosure including a panel unit having a fluorescent film formed on an inner face thereof, said fluorescent film consisting of densely arrayed three color dot trios of a fluorescent material, a shadow mask being mounted in the vicinity of said fluorescent film, a neck unit housing an electron gun for emitting three electron beams, and a funnel unit for joining said panel unit and said neck unit, wherein the diagonal diameter of an effective display area of said panel unit is not less than 455 mm and not more than 465 cm, wherein the effective display area on an outer face of said panel unit has a diagonal radius of curvature of not less than 1,300 mm, wherein the dot trios of said fluorescent material have a horizontal pitch not more than 0.22 mm, and wherein a cover film is applied to said panel unit to lower optical transmittance.

37. A color cathode ray tube according to claim 36, wherein said cover film is applied to an outer surface of said panel unit.

38. A color cathode ray tube according to claim 36, wherein said cover film includes carbon black material.

39. A color cathode ray tube according to claim 36, wherein said cover film includes pigment.

40. A color cathode ray tube according to claim 36, wherein said cover film is homogeneously applied to said panel unit.

41. A color cathode ray tube according to claim 36, wherein an optical absorption of said cover film in the green spectrum is 10% to 20%.

42. A color cathode ray tube comprising a vacuum enclosure including a panel unit having a fluorescent film formed on an inner face thereof, said fluorescent film consisting of densely arrayed three color dot trios of a fluorescent material, a shadow mask being mounted in the vicinity of said fluorescent film, a neck unit housing an electron gun for emitting three electron beams, and a funnel unit for joining said panel unit and said neck unit, wherein the diagonal diameter effective display area of said panel unit is not more than 482 cm, wherein an effective display area on an outer face of said panel unit has a diagonal radius of curvature of not less than 1,300 mm, wherein the dot trios of said fluorescent material are horizontally arrayed in a number of approximately at least 1600, wherein a radius curvature of a corner portion of said effective display area is not more than 5 mm, and wherein a cover film is applied to said panel unit to lower optical transmittance.

43. A color cathode ray tube according to claim 42, wherein said cover film is applied to an outer surface of said panel unit.

44. A color cathode ray tube according to claim 42, wherein said cover film includes carbon black material.

45. A color cathode ray tube according to claim 42, wherein said cover film includes pigment.

46. A color cathode ray tube according to claim 42, wherein said cover film is homogeneously applied to said panel unit.

47. A color cathode ray tube according to claim 42, wherein an optical absorption of said cover film in the green spectrum is 10% to 20%.

* * * * *